US006633301B1

(12) United States Patent
Dallas et al.

(10) Patent No.: US 6,633,301 B1
(45) Date of Patent: Oct. 14, 2003

(54) RGB ILLUMINATOR WITH CALIBRATION VIA SINGLE DETECTOR SERVO

(75) Inventors: James M. Dallas, Superior, CO (US); Ryan Patrick Donohue, Mountain View, CA (US); Mark A. Handschy, Boulder, CO (US); Gani Jusuf, San Carlos, CA (US); Colm Lysaght, Palo Alto, CA (US); Rainer Malzbender, Niwot, CO (US)

(73) Assignee: Displaytech, Inc., Longmont, CO (US)

( * ) Notice: Subject to any disclaimer, the term of this patent is extended or adjusted under 35 U.S.C. 154(b) by 0 days.

(21) Appl. No.: 09/313,227

(22) Filed: May 17, 1999

(51) Int. Cl.[7] ..... G09G 5/02
(52) U.S. Cl. ..... 345/597; 345/84
(58) Field of Search ..... 345/147, 432, 345/83, 82, 84, 85, 89, 597, 598, 599, 600, 603, 604, 605, 88, 690–699; 348/68, 745, 70, 181, 71, 180, 744, 189; 362/29, 30, 555, 558

(56) References Cited

U.S. PATENT DOCUMENTS 5,287,096 A * 2/1994 Thompson et al. ..... 345/147
5,369,432 A * 11/1994 Kennedy ..... 348/181
5,386,253 A * 1/1995 Fielding ..... 348/745
5,483,259 A * 1/1996 Sachs ..... 345/600
5,589,852 A * 12/1996 Thompson et al. ..... 345/147
5,650,844 A * 7/1997 Aoki et al. ..... 356/237.2
5,748,164 A * 5/1998 Handschy et al. ..... 345/89
6,108,053 A * 8/2000 Pettitt et al. ..... 348/743
6,108,122 A * 8/2000 Ulrich et al. ..... 359/291
6,188,427 B1 * 2/2001 Anderson et al. ..... 347/255
6,285,349 B1 * 9/2001 Smith ..... 345/690

* cited by examiner

*Primary Examiner*—Michael Razavi
*Assistant Examiner*—Thu Thao Havan
(74) *Attorney, Agent, or Firm*—Gene Branch; Robert G. Crouch; Marsh Fischmann & Breyfogle, LLP

(57) ABSTRACT

A display system includes a light modulator divided into an array of individually controllable pixels and an input-driven illumination device. The illumination device is adapted to receive a variable input and is configured to direct light of variable intensity onto the modulator, depending on the input. The display system further includes a calibrating arrangement for establishing the input to the illumination device to produce a desired intensity level of light. The calibrating arrangement includes a light sensing mechanism, which senses the light from the illumination device while the illumination device is driven by an initial input. The calibration arrangement is configured to determine a comparison between the sensed light and a value representative of the desired-intensity level. The calibration arrangement further includes a control arrangement responsive to the comparison for varying the input so as to provide light of the desired intensity level.

28 Claims, 6 Drawing Sheets

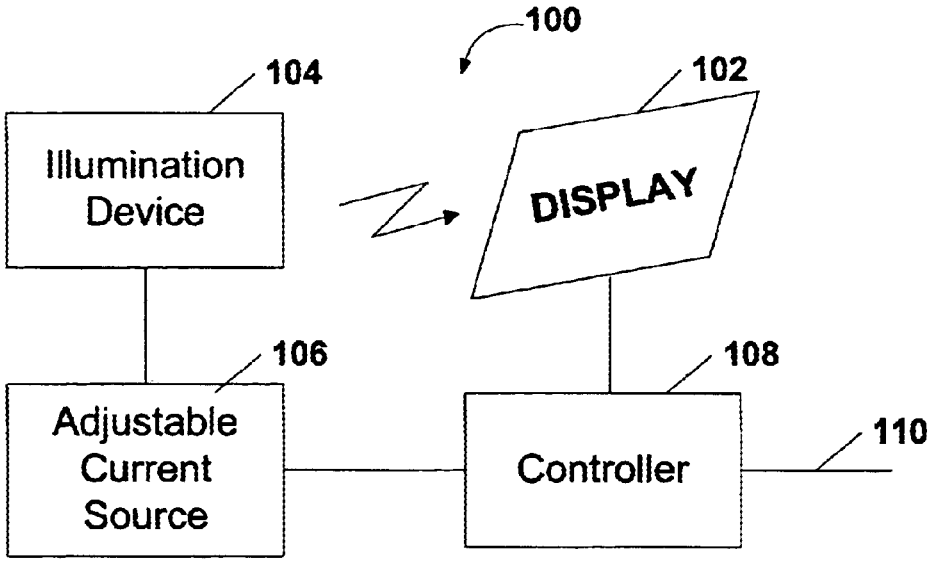
FIGURE 1 - Prior Art
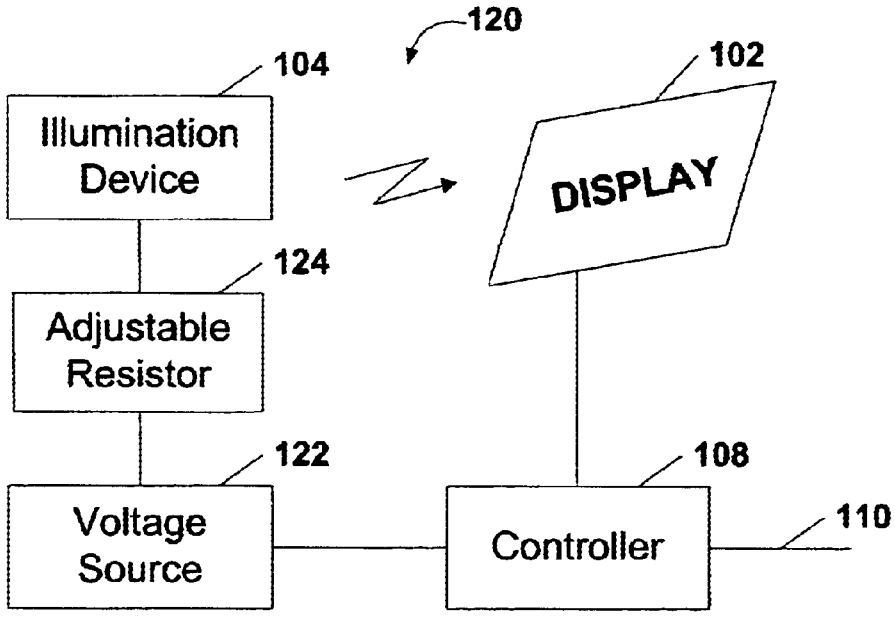
FIGURE 2 - Prior Art

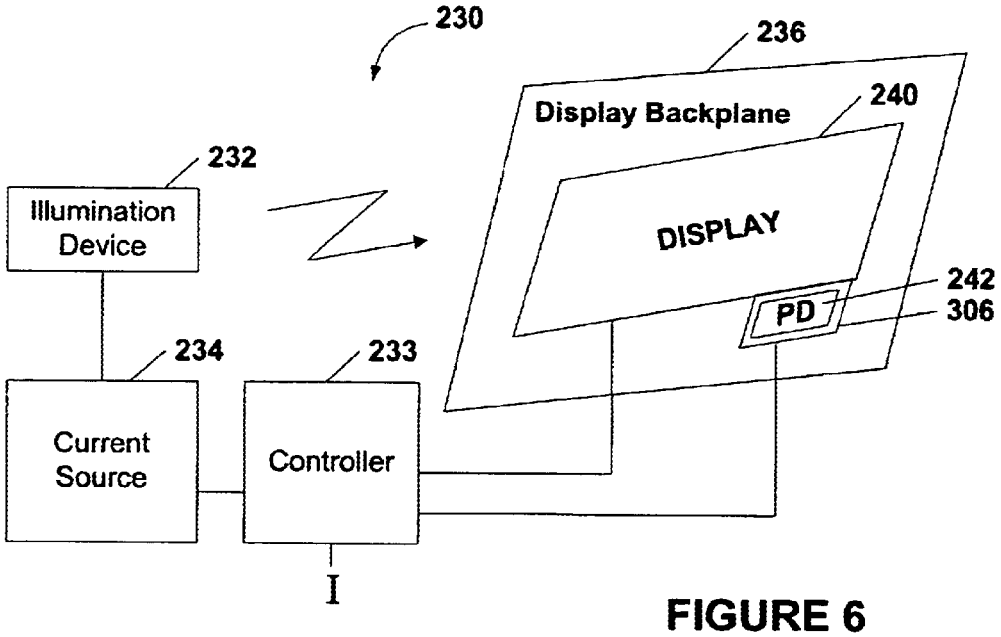
FIGURE 6
FIGURE 6a
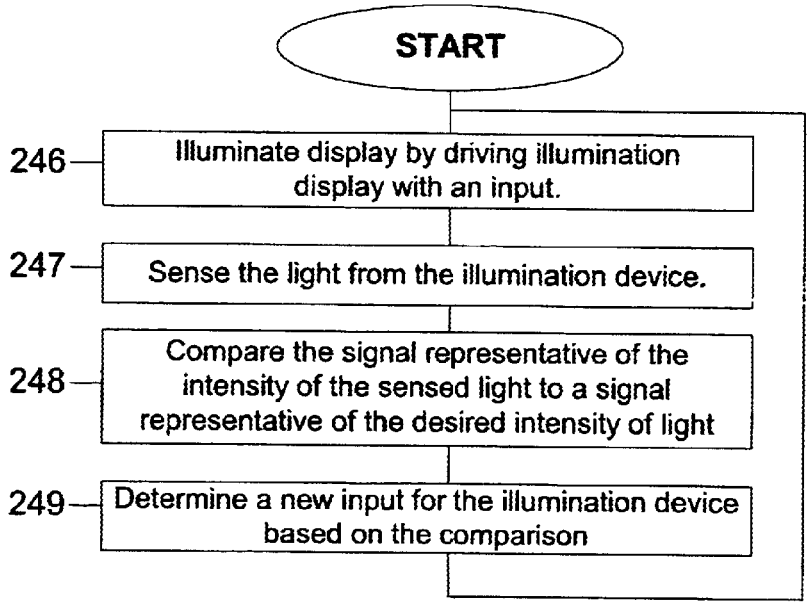

RGB ILLUMINATOR WITH CALIBRATION VIA SINGLE DETECTOR SERVO

BACKGROUND OF THE INVENTION

The present invention relates generally to methods and arrangements for calibrating illumination assemblies to obtain desired white-point, color balance and/or intensity. More specifically, the invention relates to using electronic storage devices and/or photodetectors and electronic circuitry to vary the current supplied to illumination devices such as light-emitting diodes, thus providing a calibrated light source for display applications.

In micro-display applications utilizing tri-color RGB (red, green and blue) light-emitting diode (LED) assemblies to illuminate a display panel, LED part-to-part illumination variation results in inconsistent brightness, white-point and color balance. Every LED's illumination output as a function of current is different, and each LED's illumination response to current across its entire current-controlled operating range may be non-linear. Manufacturing LEDs within tighter tolerances and more closely matching the three LED colors in a single assembly, thereby providing a more stable white-point and/or color balance, would be unnecessarily expensive, and would nevertheless provide unsatisfactory results.

Referring initially to FIG. 1, a prior art display system 100 providing a partial solution to the above-described problem will be described. Display system 100 includes a light modulating display 102, an illumination device 104, which provides the light source for display 102, and an adjustable current source 106 electrically connected to illumination device 104. Adjustable current source 106 is manually adjusted during manufacturing in order to cause illumination device 104 to provide calibrated light. The adjustment takes place by comparing the illumination output of illumination device 104 to a reference intensity and adjusting current source 106 until the illumination output of illumination device 104 matches the reference intensity. If illumination device 104 contains more than one light source, the process is repeated for each light source.

Display system 100 further includes a controller 108 and a display information input 110. During operation of display system 100, controller 108 receives display information via input 110 and determines the current to be supplied to illumination device 104. The setting made during manufacturing to adjustable current source 106 causes the current to vary proportionally to the setting, thereby providing partially calibrated light. Because the adjustment made to adjustable current source 106 during manufacturing calibrates the illumination output of illumination device 104 for only a single intensity, this system does not correct the non-linear illumination response to current of illumination device 104 across the device's entire current-controlled operating range.

Display system 100 includes the additional limitation that adjustable current source 106 must be manually set during manufacturing. Having to manually calibrate the current source increases the cost of producing such a device. FIG. 2 illustrates a display system that overcomes this particular limitation.

Referring now to FIG. 2, a second prior art display system 120 will be described using like reference numbers for like components. Display system 120 includes a voltage source 122 and an adjustable resistor 124. Adjustable resistor 124 may be a laser trim resistor that is capable of being adjusted during manufacturing using an automated process to provide the desired intensity for a specific voltage. While this method overcomes one limitation of display system 100 by allowing the calibration to be accomplished by automated means during manufacturing, display system 120 similarly fails to correct the non-linear illumination response to current of illumination device 104 across its entire current-controlled operating range. Further, neither display system 100 nor display system 120 is capable of correcting illumination device variations that occur after manufacturing, such as illumination device aging.

The present invention discloses arrangements and methods for calibrating illumination devices to reduce both pre- and post-manufacturing variations, including non-linear illumination output as a function of current across the current-controlled operating range and illumination device aging.

SUMMARY OF THE INVENTION

As will be described in more detail hereinafter, a display system including an arrangement for calibrating an input-driven illumination device is disclosed. The display system includes a spatial light modulator divided into an array of individually controllable pixels and an input-driven illumination device which is adapted to receive a variable input and which is configured to direct light of variable intensity onto the modulator, depending on the input. The display system further includes an arrangement adapted for connection with the illumination device for providing to the illumination device a specific input for a desired intensity level of the light, the specific input being provided from calibration information particular to the illumination device. The arrangement further includes a memory device for storing the calibration information.

A method of operating a display system as described above includes determining calibration information for an input driven illumination device which is adapted to receive a variable input and which is configured to direct light of variable intensity onto a light modulator, depending on the input. The method further includes storing the calibration information in a memory device and establishing a specific input for a desired intensity level of the light from the calibration information. The method further includes providing the specific input to the illumination device, and directing the light of the desired intensity level onto the light modulator.

As will be described in more detail hereinafter, an illumination assembly, including calibration information is also disclosed. The illumination assembly includes an input-driven illumination device which is adapted to receive a variable input and which is configured to produce light of variable intensity depending on the input. The illumination assembly further includes an arrangement including a memory device for storing calibration information and generating from the information a specific input for causing the illumination device to produce light of a particular intensity. The arrangement is adapted to be connected with the illumination device such that the latter receives the specific input.

In another embodiment of a display system, the display system includes a light modulator and an input-driven illumination device which has been pre-calibrated to provide light of a given intensity in response to a particular input and which is configured to direct the light onto the modulator. The display system further includes an electronic storage arrangement for storing a value which corresponds to the particular input, and an arrangement responsive to the value in the electronic storage means for generating the particular input and using it to drive the illumination device in a way which provides light of the given intensity.

A method of operating a display system as described above includes determining a particular value for controlling the input to an input-driven illumination device and electronically storing the particular value. The method further includes driving the illumination device in response to the particular value in a way which produces light of a desired intensity level, and directing the light of the desired intensity level onto a light modulator.

In a preferred embodiment, the display system includes a light modulator divided into an array of individually controllable pixels and an input-driven illumination device which is adapted to receive a variable input and which is configured to direct light of variable intensity onto the modulator, depending on the input. The display system further includes a calibrating arrangement for establishing the input for a desired intensity level of the light. The arrangement includes a light sensing mechanism, which senses the light from the illumination device while the illumination device is driven by an initial input. The calibration arrangement is configured to determine a comparison between the sensed light and a value representative of the desired intensity level. The calibration arrangement further includes a control arrangement responsive to the comparison for varying the input so as to provide light of the desired intensity level. The light sensing mechanism may form part of the light modulator.

The input-driven illumination device in either of the aforementioned display systems or the aforementioned illumination assembly may contain one, and only one, light source. Alternatively, the illumination device may include a plurality of light sources, wherein the calibration arrangement is designed to establish the input for a desired intensity level for each light source, so as to produce combined light of a desired color. The particular intensity of light produced by each light source may be different. The desired color may be white. The illumination device may consist of red, green and blue light-emitting diodes.

In the aforementioned display system, the sensing mechanism may be a photodetector. The sensing mechanism may be configured to sense only light within the visible spectrum. The sensing mechanism may be configured to have photopic spectral response substantially similar to the human eye.

A method of operating the immediately aforementioned display system includes providing an input-driven illumination device which is adapted to receive a variable input and which is configured to direct light of variable intensity onto a light modulator depending on the input. The method further includes sensing the light from the illumination device while the illumination device is driven by an initial input and comparing the sensed light to a value representative of the desired intensity. The method further includes establishing the input for a desired intensity level of the light in response to the comparison and directing the light of the desired intensity level onto the light modulator.

In another embodiment similar to the immediately preceding embodiment of a display system, the spectral response of the photodetector may vary from photodetector to photodetector, and the value representative of the desired intensity level is pre-calibrated to vary proportionally with the photodetector spectral response variation. Also, the sensing mechanism may include a plurality of photodetectors, each configured to sense light of a specific range of wavelengths and wherein each range of wavelengths is different.

In another embodiment, a color display includes a light modulator and a plurality of different colored lights, each of which are pre-calibrated to provide light of a given intensity in response to an input of a particular value. The lights are configured to direct the light onto the modulator. This embodiment includes an improvement that includes an electronic storage arrangement for storing the particular value and a control arrangement responsive to the particular value in the electronic storage arrangement for driving the light sources in a way which provides light of the given intensity.

BRIEF DESCRIPTION OF THE DRAWINGS

The features of the present invention may best be understood by reference to the following description of the presently preferred embodiments together with the accompanying drawings.

FIG. 1 is a diagrammatic illustration of a first prior art display system.

FIG. 2 is a diagrammatic illustration of an alternative prior art display system.

FIG. 6 is a diagrammatic illustration of a third embodiment of a display system designed in accordance with the present invention.

FIG. 6*a* is a flow diagram illustrating the various steps of a method of operating a display system in accordance with the invention.

DETAILED DESCRIPTION OF THE PREFERRED EMBODIMENTS

An invention is herein described for providing methods and arrangements for calibrating the illumination output of illumination devices used, for instance, in display applications. In the following description, numerous specific details are set forth in order to provide a thorough understanding of the present invention. However, in view of this description, it will be obvious to one skilled in the art that the present invention may be embodied in a wide variety of specific configurations. In order not to unnecessarily obscure the present invention, known manufacturing processes will not be described in detail. Also, the various components used to produce illumination devices and display systems, other than the novel circuitry, will not be described in detail. These components are known to those skilled in the art of display systems and their associated illumination devices.

Figure 3:
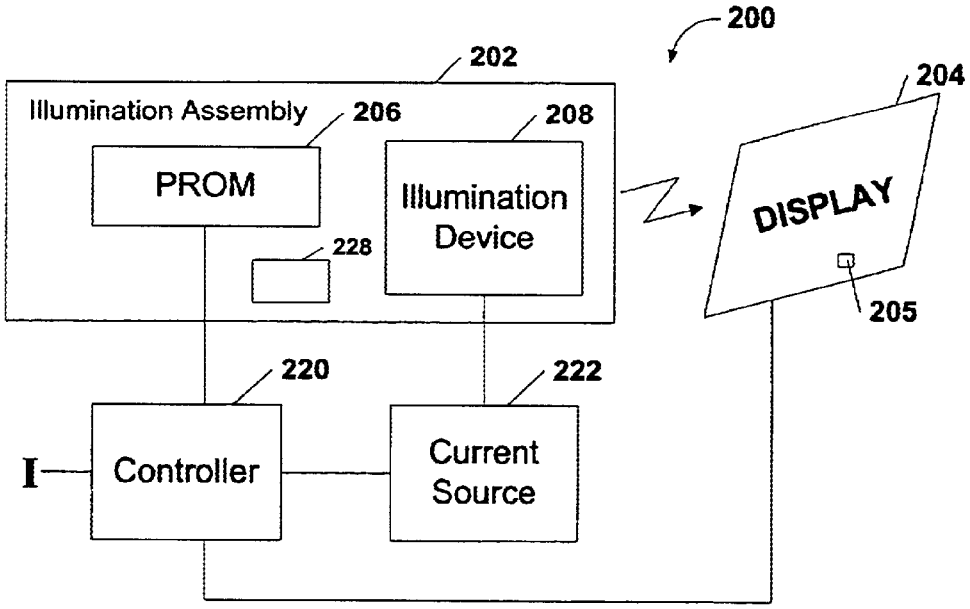
FIG. 3 is a diagrammatic illustration of a first embodiment of a display system designed in accordance with the present invention.

Referring to FIG. 3, a first embodiment of a display system 200 designed in accordance with the present invention will be described. Display system 200 includes an illumination assembly 202 and a light modulating display 204 having an array of pixels 205. One such novel display system is disclosed in U.S. Pat. No. 5,748,164, entitled ACTIVE MATRIX LIQUID CRYSTAL IMAGE GENERATOR, and issued May 5, 1998, which patent is incorporated herein by reference. A display system of this type is further described in U. S. Pat. No. 5,808,800, entitled OPTICS ARRANGEMENTS INCLUDING LIGHT SOURCE ARRANGEMENTS FOR AN ACTIVE MATRIX LIQUID CRYSTAL IMAGE GENERATOR, and issued Sep. 15, 1998, which patent is also incorporated herein by reference. Illumination assembly 202 provides the light source for light-modulating display 204. Those skilled in the art of micro-displays understand that images are displayed on display system 200 by switching pixels 205 between various optical states in response to image data supplied at the display information input I, thereby forming a pattern of modulated light. The system is operated by displaying image frames at a certain frame rate in order to produce a viewable image. In the case of a sequential color system, each frame is typically divided into subframes or fields for sequentially displaying each of the different primary-color separations of the image. These color fields are displayed at a rate faster than the critical flicker frequency of the human eye. Therefore, the color fields of the different colors are integrated by the viewer's eye. The color sensed by the eye of a person viewing the display depends on the ratio of intensities of the primary colors in any given portion of the image displayed. The relative intensities of the light sources at different brightness levels are therefore important to producing the correct colors in the final image. It is sufficient, however, to calibrate the light source to produce white light at a desired color and intensity, because the system is thereby calibrated to produce other colors correctly when the system is operated as described above.

Continuing to refer to FIG. 3, illumination assembly 202 further includes a memory device 206 and an illumination device 208. Memory device 206 may be any standard electronic memory device. Preferably memory device 206 is a semiconductor memory such as an SRAM (static random access memory) or DRAM (dynamic random access memory). Even more preferably, memory device 206 is a non-volatile semiconductor memory such as a programmable read-only memory (PROM), EEPROM (electrically erasable programmable read-only memory), or "flash" memory device. Illumination device 208 may be LEDs, laser diodes, incandescent lamps, fluorescent lamps, or any other illumination device capable of being calibrated. Calibration methods may include adjusting the illumination device drive current, voltage, and/or any other parameter(s) that changes the illumination intensity. Although specific examples have been given for memory device 206 and illumination device 208, the present invention is not limited to these specific examples; other devices may be used that nevertheless remain within the scope of the present invention. Memory device 206 may store one or more calibrating values, each representing the current required to provide light of a specific intensity from illumination device 208. In this embodiment the calibrating values are determined and placed in memory device 206 utilizing the calibration arrangement such as calibration arrangement 210 of FIG. 4.

Figure 4:
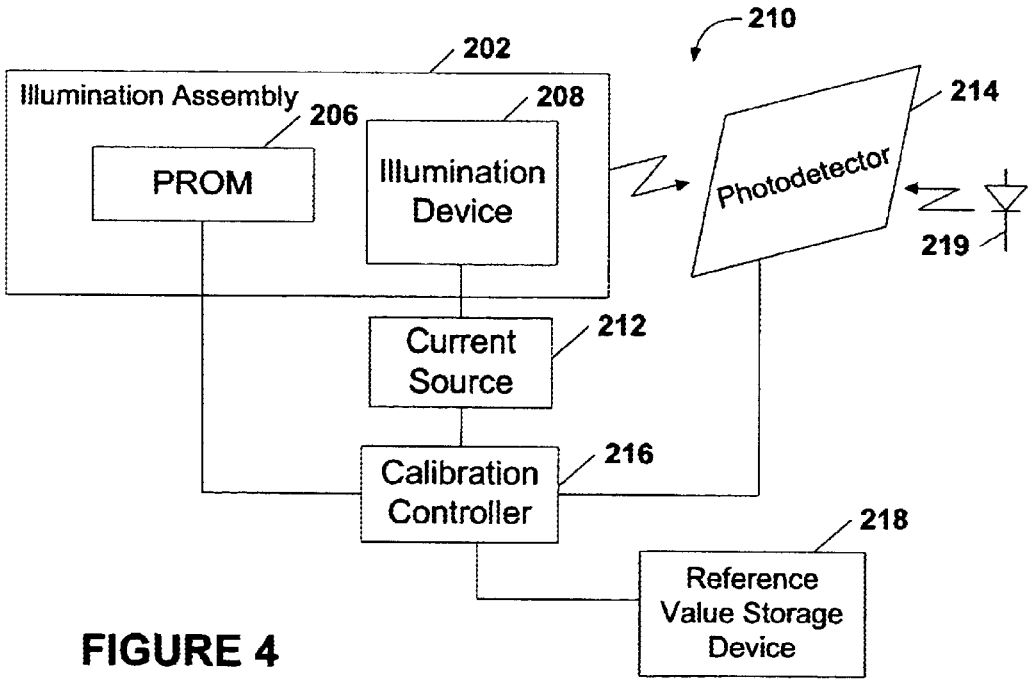
FIG. 4 is a diagrammatic illustration of a calibration arrangement for calibrating a display system designed in accordance with the present invention.

Referring to FIG. 4, one possible arrangement, calibration arrangement 210, for calibrating illumination assembly 202 will be described. Calibration arrangement 210 includes a current source 212, a light sensing device 214 to measure the intensity of light from illumination device 208, a calibration controller 216 connected electrically to light sensing device 214, and a reference value storage device 218 connected electrically to calibration controller 216. Light sensing device 214 may be a photodetector or any other device capable of converting an optical signal into an electrical signal representative of the illumination intensity of the optical signal.

During a manufacturing calibration process, current source 212 supplies a specific current to illumination device 208. Light sensing device 214 measures the intensity of the light produced by illumination device 208, and calibration controller 216 compares the measured intensity unique to illumination device 208 to a reference value representing the desired intensity, the reference value being stored in reference value storage device 218. The reference value may be obtained by exposing the same light sensing device 214 to a reference or standard light source 219 and causing the value of the measured light level to be stored in the reference value storage device 218. Based on the comparison, calibration controller 216 causes current source 212 to vary the current supplied to illumination device 208 until the intensity of light provided by illumination device 208 matches the reference intensity. Once illumination device 208 is providing the desired intensity of light, calibration controller 216 causes a calibrating value unique to illumination device 208 to be stored in memory device 206. The calibrating value may be the specific current required to produce light of the desired intensity, or any other calibrating value capable of allowing a controller 220 of FIG. 3 to determine the correct current to provide to illumination device 208 in order to produce light of the desired intensity. The process may be repeated for a plurality of desired intensity levels. Thus, memory device 206 may store a plurality of calibrating values representing the current required to produce light of various specific intensities.

Returning again to FIG. 3, display system 200 further includes controller 220 electrically connected to memory device 206 and a current source 222. In this embodiment, current source 222 is also electrically connected to illumination device 208. The current source provides electrical drive appropriate to the illumination device and can be of any of the types well known in the art associated with the various types of illumination devices. In particular, if the illumination device is made from LEDs, in may be preferred to provide electrical drive whose drive current does not depend on the LED forward voltage drop. Electronic circuits of this capability are well known in the art. Furthermore, it may be desired to have current source 222 respond to a digital input from controller 220, in which case current source 222 may incorporate a digital-to-analog converter (DAC) giving it the capability of providing an output current that varies in response to a digital input from the controller. As is known in the art, light modulating display 204 can be implemented on a silicon integrated circuit. In this case, controller 220 and current source 222 may also be implemented on the same integrated circuit.

During operation of display system 200, controller 220 receives display information via input I. Controller 220 uses the display information in combination with the calibrating value stored in memory device 206 to cause current source 222 to provide the particular amount of current to illumination device 208 in order to produce light of a desired intensity. The desired intensity of light to be produced at any particular time may be the same as or different from the intensities for which calibrating values are stored in memory device 206. For example, if the desired intensity is the same intensity for which a calibrating value is stored in memory device 206, then controller 220 causes current source 222 to provide current corresponding to that value. If, however, the desired intensity is different from any intensity for which calibrating values are stored in memory device 206, then controller 220 interpolates between values to determine the correct current to produce light of the desired intensity. If only one calibrating value is stored in memory device 206, then controller 220 interpolates between that calibrating value and zero current, which represents zero intensity, to determine the current necessary to produce light of the desired intensity. Controller 220 then causes current source 222 to provide that current to illumination device 208. This method of interpolating between multiple calibrating values stored in memory device 206 provides the advantage that illumination assembly 202 may be calibrated to correct the non-linear response illumination device 208 has to current.

Figure 5:
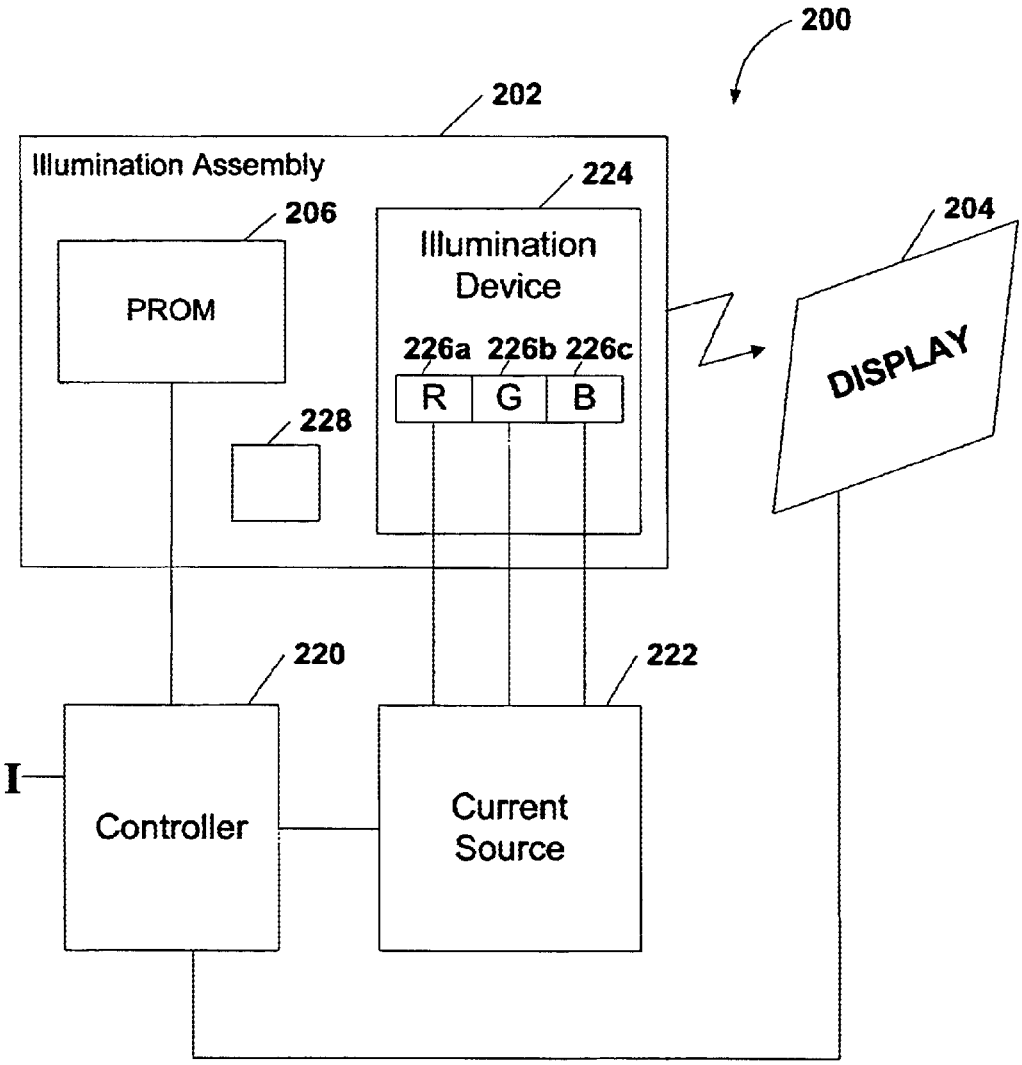
FIG. 5 is a diagrammatic illustration of a second embodiment of a display system designed in accordance with the present invention.

Referring now to FIG. 5, an alternative illumination device 224 and its operation will be described. In this embodiment, illumination device 224 includes a plurality of light sources, specifically red, green and blue light-emitting diodes (LEDs) indicated by reference numbers 226*a–c*. Memory device 206 stores one or more calibrating values for each light source, each value representing the current required to provide light of a particular intensity for the associated light source. Ideally, memory device 206 stores the calibrating values for each light source representing the current required for each light source to produce light that, when combined, produces light of a chosen color, color temperature, and/or white point. Further, if memory device 206 is configured to store more than one value for each light source, the stored values represent the current required to produce white light at various specific brightness levels. As a result, illumination assembly 202, when operated as described above, is calibrated to provide a stable white-point for various brightness levels. In this embodiment the calibrating values stored in memory device 206 for each light source of illumination device 224 are determined and placed in memory device 206 using a calibration arrangement such as calibration arrangement 210 of FIG. 4 as described above.

The calibration process is carried out in a way similar to that described above with reference to FIG. 4. Current source 212 supplies current to each light source 226*a–c* in sequence. As each light source is illuminated, light sensing device 214 measures the intensity of light produced, and calibration controller 216 compares the measured intensity to a reference value from reference value storage device 218. Calibration controller 216 then causes current source 212 to vary the current until the light source is producing light of the desired intensity.

Calibration controller then causes calibration information unique to the light source to be stored in memory device 206. The process is repeated for each light source 226*a–c* and for all desired brightness levels of each light source. Thus memory device 206 ultimately contains values unique to each light source 226*a–c*.

The reference values stored in device 218 may preferably have been obtained in sequence by exposing the same light sensing device 214 to a reference light source that produces a sequence of red, green, and blue illuminations. In this case it is desirable that light sensing device 214 have a spectral response that mimics that of the human eye (i.e. that it have a "photopic" response). In this way the effect of output spectral variation from the light sources in one illumination device 208 to those in the next illumination device on the achieved white point can be minimized. Alternately, it is desirable that the spectra of the red, green, and blue illuminations provided by the reference light source match the spectra of the red, green, and blue LEDs of light source 224.

Although the present embodiment has been described having RGB LEDs, it should be understood that the present invention is not limited to RGB LEDs or even LEDs. The present invention may be used to calibrate any light source, combination of light sources and/or combination of colors of light sources. Also although illumination device 224 has been described as being configured to produce white light with a stable white-point, this is not a requirement. Instead, light sources with a wide variety of colors may be mixed in a wide variety of manners to produce any desired color when combined. Also, as described previously with reference to FIG. 3, the controller and/or current source can be fabricated with display 204 as a single integrated circuit.

Returning to FIGS. 3 through 5, one additional advantage provided by illumination assembly 202 will be described. Often in manufacturing operations, components such as display 204, illumination assembly 202, current source 222 and controller 220 are not assembled into a combined product until late in the manufacturing process. By providing memory device 206 and either illumination device 208 or illumination device 224 as an integrated sub-assembly, the calibration process of FIG. 4 may take place early in the manufacturing process. This is because the particular illumination device contained on the sub-assembly remains coupled throughout the manufacturing process with memory device 206 and the calibrating value stored therein that is unique to that specific illumination device. Further, illumination assembly 202 may be integrated with any combination of controller 220, current source 222 and display 204, without requiring further calibration, again because the unique calibrating value for the illumination device remains coupled with the illumination device. However, this advantage requires that memory device 206 is capable of maintaining the calibrating values without requiring an external power source. One particular example of a memory device capable of maintaining stored information without the need for external power is programmable read-only memory (PROM). However, the present invention is not limited to PROM; any memory device capable of maintaining its stored value without external power may be used. Alternatively as illustrated in FIGS. 3 and 5, illumination assembly 202 may include an appropriate power supply 228 such as a battery or capacitor to power the memory device, and allow it to retain its calibration values during the interval between the calibration operation and the use of the display.

Turning now to FIG. 6, another embodiment of the present invention will be described. FIG. 6 illustrates a display system 230 designed in accordance with the present invention. Display system 230 includes an illumination device 232 electrically connected to a controller 233 via a current source 234. Display system 230 further includes a display backplane 236, which is illuminated by illumination device 232. Display system 230 further includes a light modulating display 240 and a light sensing device 242. Light modulating device 240 operates to form images, as previously described. Light sensing device 242 may be a photodetector or any other device capable of converting an optical signal into an electrical signal representative of the illumination intensity of the optical signal. As mentioned previously, display backplane 236 can be implemented as a silicon integrated circuit. In this case light sensing device 242 can easily be implemented on the same integrated circuit, for example as a photodiode or phototransistor, using techniques well known in the integrated circuit art. Controller 233 and current source 234 may also be implemented on the same integrated circuit.

During operation of display system 230, illumination device 232 illuminates display backplane 236 in response to current supplied by current source 234. Current source 234 provides current in response to control information provided by controller 233. Controller 233 determines the control information to supply to current source 234 based on information supplied by light sensing device 242 in combination with display information from a display information input I. The display information supplied via display information input I includes information directing a desired intensity level of light to be supplied by illumination device 232. Controller 233 compares this desired intensity level with the output from light sensing device 242, which represents the intensity of light being sensed. Controller 233 then varies the control information supplied to current source 234 so as to adjust the intensity of light from illumination device 232 until it matches the desired intensity. In this embodiment, the calibration arrangement of display system 230 acts as a servomechanism with continuous feedback for adjusting the light output of illumination device 232 to achieve and maintain the desired intensity of light.

Referring now to FIG. 6*a* in combination with FIG. 6, a method of operating display system 230 will be described. As mentioned previously, display system 230 includes illumination device 232 and display 240. In this embodiment, the method includes the step of causing the illumination device to illuminate the display by driving it with an initial input as indicated by block 246. As indicated by block 247 of FIG. 6*a*, this method further includes the step of sensing the light from the illumination device. Block 248 includes the step of comparing the signal representative of the intensity of the sensed light to a signal representative of the desired intensity of light. Finally, block 249 includes the step of determining a new input for the illumination device, based on the comparison from the previous step, for causing the illumination device to produce light of the desired intensity.

Illumination device 232 of FIG. 6 could contain multiple light sources of different colors, in the same manner as was described with reference to FIG. 5, to create a sequential-color display system. In this case, the calibration servomechanism, with single light sensing device 242 can function nevertheless according to the above method. Controller 233 switches each different-colored light source within illumination device 232 on one at a time. Light sensing device 242 then measures in turn the intensity of each light source, and controller 233 acts on current source 234 to bring the measured intensity to its desired value.

Figure 7:
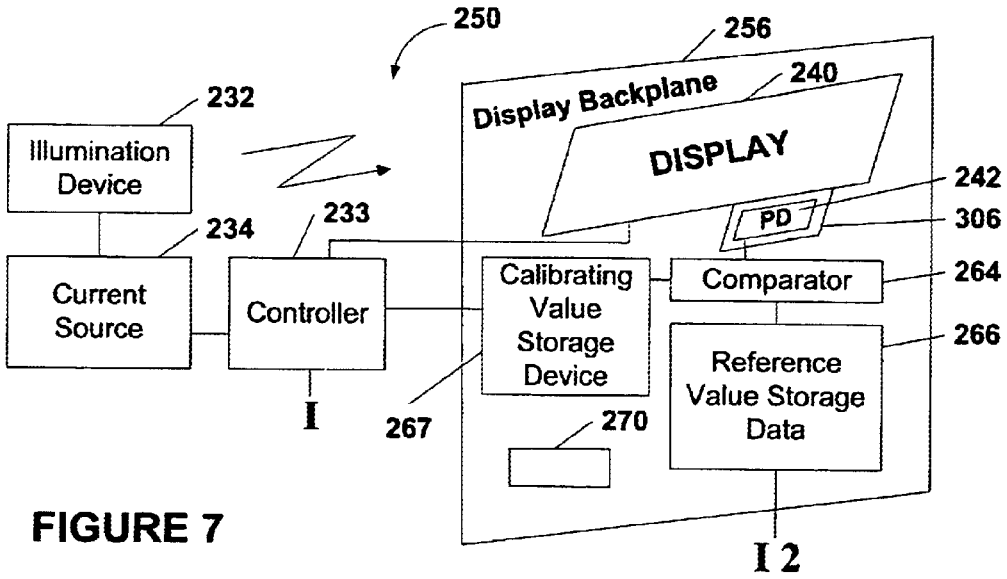
FIG. 7 is a diagrammatic illustration of a fourth embodiment of a display system designed in accordance with the present invention.

Turning now to FIG. 7, another embodiment of the present invention will be described. FIG. 7 illustrates a display system 250 designed in accordance with the present invention and containing many of the same elements of display system 230 of FIG. 6. Like reference numbers are used for like elements between FIGS. 6 and 7. However, the display backplane 256 of display system 250 further includes a comparator 264, a reference value storage device 266 and a calibrating value storage device 267. In this embodiment reference value storage device 266 may be non-volatile programmable read-only memory, or may be conventional SRAM or DRAM circuitry, or circuitry designed to represent a specific value or values. Additionally, display system 250 includes input I2, for selecting specific memory locations within reference value storage device 266. Comparator 264 is electrically connected to both light sensing device 242 and reference value storage device 266. Comparator 264 is configured for comparing values representing sensed light intensity received from light sensing device 242, to reference intensities provided by reference value storage device 266 and selected from reference value storage device 266 using information from input 12. Comparator 264 is also electrically connected to calibrating value storage device 267. Calibrating value storage device 267 may be any programmable memory capable of being reprogrammed with new information following a calibration process.

During operation of display system 250, illumination device 232 illuminates display backplane 256 in response to current supplied by current source 234. Current source 234 provides current in response to control information provided by controller 233. Controller 233 determines the control information to supply to current source 234 based on information supplied from calibrating value storage device 267 in combination with display information from a display information input I. The information supplied from calibrating value storage device 267 is calibration information determined during a calibration process.

In a first embodiment of a calibration process in accordance with the present invention, illumination device 232 is driven by a reference current from current source 234. Light sensing device 242 senses the light from illumination device 232 and provides light intensity information to comparator 264. Comparator 264 compares the sensed light with a reference value from reference value storage device 266. This reference value may be derived from an earlier exposure of light sensing device 242 to a reference light source, as described previously. Comparator 264 then causes a calibrating value that is unique to illumination device 232 to be stored in calibrating value storage device 267. Controller 233 later uses the comparison to appropriately adjust the control information supplied to current source 234, thereby varying the current supplied to illumination device 232 in proportion to the comparison.

The calibration process described above may be repeated for various brightness levels and for multiple light sources included in illumination device 232. By determining calibrating values for various brightness levels, display system 250 is capable of correcting the light source's non-linear response to current in the same manner as previously described for display system 202 of FIG. 3. Further, by determining calibrating values for multiple light sources included in illumination device 232, display system 250 is able to provide a stable white-point and color balance. Finally, by determining calibrating values for various brightness levels and multiple light sources, display system 250 is capable of providing a stable white-point and color balance across the system's current-controlled operating range. It should be understood that calibrating value storage device 267 must be capable of storing values representing calibration information for all light sources and all brightness levels. For example, if three light sources are included in illumination device 232 and values are stored for two brightness levels, then calibrating value storage device 267 must contain six memory locations.

If in the embodiment described, display backplane 256 contains no internal power source and calibrating value storage device 267 is a volatile memory device, then calibrating value storage device 267 is not capable of maintaining its stored values without external power. As a result, the calibration process described above must be repeated following each external power interruption. However, this configuration provides the advantage that the calibration process corrects post-manufacturing variations, such as LED aging, that result in light source intensity differences. Alternatively, calibrating value storage device 267 could be non-volatile memory, such as flash, or a readily providable power source could be easily incorporated into display backplane 256 of display system 250 as demonstrated by power source 270 of FIG. 7. This would allow calibration to take place during manufacturing and negate the need to recalibrate the system following each power interruption.

The present embodiment functions best if the part-to-part spectral response variation of light sensing device 242 is small. The following embodiment provides a display system that functions correctly even with large spectral variation.

Figure 8:
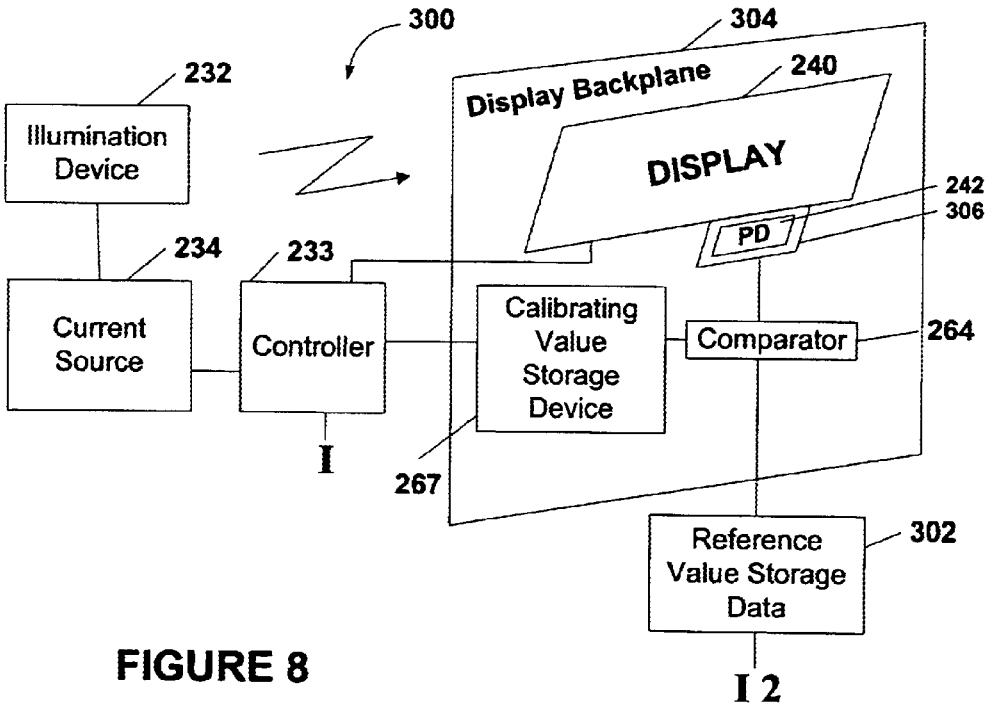
FIG. 8 is a diagrammatic illustration of a fifth embodiment of a display system designed in accordance with the present invention.

Referring now to FIG. 8, another embodiment designed in accordance with the present invention will be described. FIG. 8 illustrates a display system 300 that functions in a similar manner to display system 250 of FIG. 7, except that display system 300 includes a reference value storage device 302 and a display backplane 304. Reference value storage device 302 of display system 300 need not be located on display backplane 304 as in display system 250. Reference value storage device 302 is made of a non-volatile memory type, or is provided with a power supply. Further, although reference value storage device 302 contains reference intensity information as described in the previous embodiment, the reference value(s) for the present embodiment is/are adjusted during a sensing device calibration manufacturing process to account for spectral response variation of light sensing device 242. The sensing device manufacturing calibration process takes place as follows.

In one embodiment of a sensing device calibration manufacturing process, display backplane 304 is illuminated by light of a reference intensity and color. Light sensing device 242 measures the intensity of the light, and the intensity reference value that is unique to light sensing device 242 is stored in reference value storage device 302. The process is repeated for each light source within illumination device 232 (for example, different colored LEDs) and all desired brightness levels for each of those light sources.

During operation of display system 300, the reference value is provided to comparator 264 during a calibration process as described for display system 256 of FIG. 7. Thereby, this embodiment corrects the spectral response variation of light sensing device 242.

Referring now to FIGS. 6 through 8 an additional potential problem that may be encountered during operation of display system 230, display system 250 or display system 300 will now be described. Some light sources that may be included in illumination device 232 have the potential for emitting light with a wavelength outside the visible spectrum. Because light sensing device 242 is not necessarily limited to sensing light of wavelengths within the visible spectrum, light emitted by illumination device 232 outside the visible spectrum will be sensed, and the calibration process may provide inaccurate calibration information. In order to overcome the aforementioned potential problem, a filter 306 may be positioned over light sensing device 242. Filter 306 may be designed to pass only light having a wavelength within the visible spectrum, thereby preventing any light from outside the visible range being measured by light sensing device 242.

Alternatively, filter 306 may be designed to solve yet another potential problem that may arise in display system applications. Part-to-part spectral output variation for a typical light source used in display system applications may produce unacceptable color balance and white-point stability, even when calibrated in accordance with the present invention. This occurs because the typical light sensing device measures light intensity irrespective of the wavelength of light being measured. Therefore, a light source may produce light of an undesired wavelength, yet this fact would go undetected by the previously described display systems. To solve this problem filter 306 may be a photopic response filter having the same wavelength variation sensitivity as a human eye. As a result, the light sensing device will have the same response to light source spectral variations as the human eye, and desired white-point calibration will be obtained.

Figure 9:
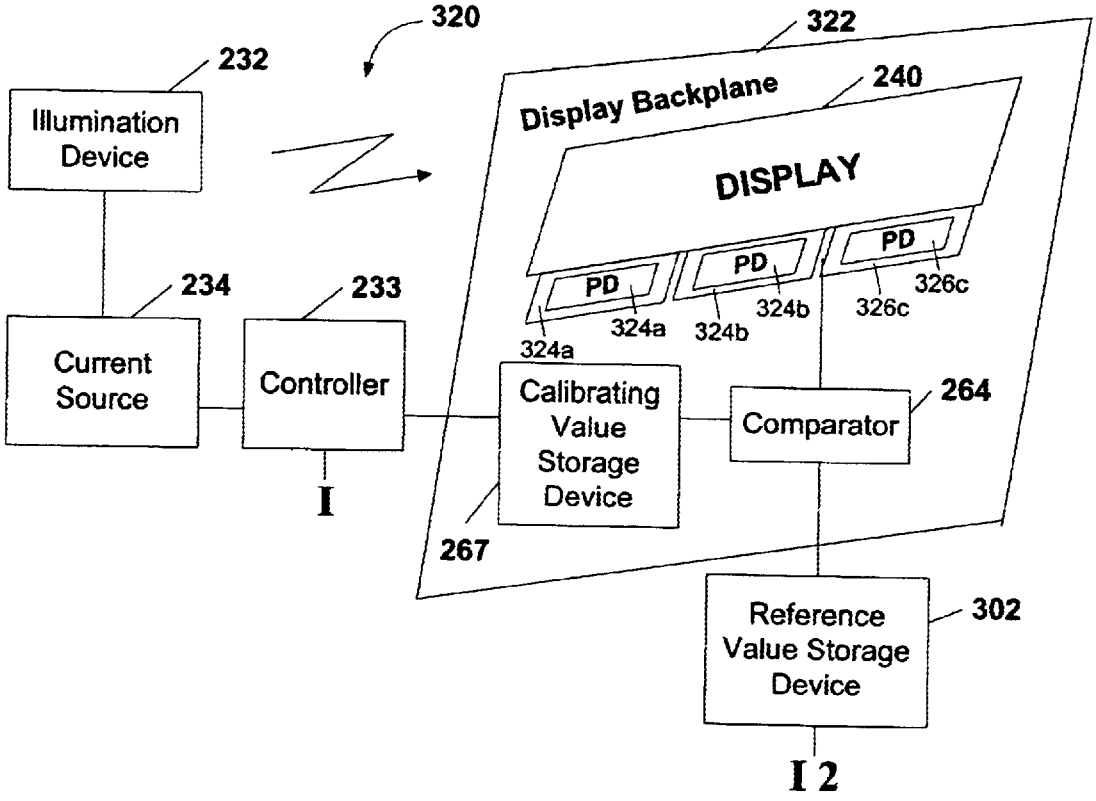
FIG. 9 is a diagrammatic illustration of a sixth embodiment of a display system designed in accordance with the present invention.

Referring to FIG. 9, another embodiment of the present invention, display system 320, will be described that also solves the potential problem of light source spectral response output variation. Display backplane 322 of display system 320 includes a plurality of light sensing devices 324*a–c*, each configured to measure only light of a specific range of wavelengths, and each configured to measure a different range of wavelengths of light. For example, display system 320 could include three light sensing devices for measuring the three primary colors, red, green and blue. Light sensing devices 324*a–c* may have filters 326*a–c* positioned so as to filter the light being sensed by devices 324*a–c*. Alternatively, light sensing devices 324*a–c* may be photodetectors specifically designed with a particular spectral response variation so as to be more sensitive to light within specific wavelength ranges. For light sensing devices implemented as photodetectors on an integrated circuit, spectral sensitivity can be tailored by the design of the photodetector, for example whether or not the photodetector is implemented directly in the silicon substrate or is alternately implemented in a CMOS well. During a calibration process similar to that described above for display system 250 of FIG. 7, light sensing devices 324*a–c* measure the intensity of light from individual light sources contained in illumination device 232. Comparator 264 compares the measured intensities to reference values for the specific wavelengths of sensed light and causes the comparison information to be stored in calibrating value storage device 267. Controller 233 later uses the comparison to appropriately adjust the control information supplied to current source 234, thereby varying the current supplied to illumination device 232 in proportion to the comparison.

Although only a few embodiments of an illumination device and a display system designed in accordance with the present system have been described in detail, it should be understood that the present invention may take on a wide variety of specific configurations and still remain within the scope of the present invention. For example the invention embodied in display system 320 of FIG. 9 may be embodied in a display system similar to display system 230 of FIG. 6 (i.e., without elements comparator 264, calibration value storage device 267, and reference value storage device 302). Therefore, the present examples are to be considered as illustrative and not restrictive, and the invention is not to be limited to the details given herein, but may be modified within the scope of the appended claims.

What is claimed is:

1. A display system comprising:

a spatial light modulator divided into an array of individually controllable pixels;

a separate input-driven illumination device selected from a group of similar illumination devices which are each adapted to receive a variable input and configured to direct light of variable intensity onto the modulator, depending on said input; and an arrangement adapted for connection with the selected illumination device for providing to the selected illumination device a specific input for a desired intensity level of said light, said specific input being provided from predetermined calibration information that is particular to the selected illumination device, said arrangement including a memory device for storing said calibration information.

2. A display system according to claim 1, wherein said predetermined calibration information is stored in said memory device in binary form.

3. A display system according to claim 1, wherein said memory device is programmable read-only memory.

4. A display system according to claim 1, wherein the selected illumination device contains one, and only one, light source.

5. A display system according to claim 1, wherein the selected illumination device contains a plurality of light sources for producing light of different colors and wherein the predetermined calibration information includes a specific value for each light source wherefrom a specific input for each light source is generated so as to cause each light source to produce light of a particular intensity corresponding to its specific input whereby the light sources together produce combined light of a desired color.

6. A display system according to claim 5, wherein the desired color is white.

7. A display system according to claim 5, wherein the particular intensity of light produced by each light source is different.

8. A display system according to claim 5, wherein the illumination device consists of red, green and blue light-emitting diodes.

9. A display system comprising:

a light modulator divided into an array of individually controllable pixels;

a separate input-driven illumination device having one or more light sources which are adapted to receive variable inputs and which are configured to direct light of variable intensities onto the modulator, depending on said inputs; and a calibrating arrangement for establishing the inputs for a desired intensity level of said light from each light source, the arrangement including a light sensing mechanism which senses said light from one light source at a time while each light source is driven by an initial input, the calibration arrangement being configured to determine a comparison between the sensed light and a value representative of the desired intensity level of light from the light source, the calibration arrangement further including means responsive to the comparisons for varying the inputs so as to provide light of said desired intensity level from each light source.

10. A display system comprising:

a light modulator;

a separate input-driven illumination device having a plurality of light sources which are adapted to receive variable inputs and which are configured to direct light of variable intensities onto the modulator, depending on said inputs; and a calibrating arrangement for establishing the inputs for a desired intensity level of said light from each light source, the arrangement including a light sensing mechanism forming part of the light modulator which senses said light from one light source at a time while each light source is driven by an initial input, the calibration arrangement being configured to determine a comparison between the sensed light and a value representative of the desired intensity level of light from the light source, the calibration arrangement further including means responsive to the comparisons for varying the inputs so as to provide light of said desired intensity level from each light source.

11. A display system according to claim 9, wherein the light sensing mechanism forms part of the light modulator.

12. A display system according to claim 9, wherein the comparison is determined each time operation of the system is initiated.

13. A display system according to claim 9, wherein the illumination device contains one, and only one, light source.

14. A display system according to claim 9, wherein the illumination device includes a plurality of light sources and wherein said calibration arrangement is designed to establish the input for a desired intensity level for each light source whereby to produce combined light of a desired color.

15. A display system according to claim 14, wherein the particular intensity of light produced by each light source is different.

16. A display system according to claim 14, wherein the desired color is white.

17. A display system according to claim 14, wherein the illumination device consists of red, green and blue light-emitting diodes.

18. A display system according to claim 9, wherein said sensing mechanism is a photodetector.

19. A display system according to claim 9, wherein said sensing mechanism is configured to sense only light within the visible spectrum.

20. A display system according to claim 9, wherein said sensing mechanism is configured to have photopic spectral response substantially similar to the human eye.

21. A method of operating a display system comprising the steps of:

a) providing an input-driven illumination device having one or more light sources which are adapted to receive variable inputs and which are configured to direct light of variable intensities onto a light modulator depending on said inputs;

b) sensing said light from one light source at a time while each light source is driven by an initial input;

c) comparing the sensed light to a value representative of the desired intensity;

d) establishing the inputs for a desired intensity level of said light from each light source in response to the comparisons; and e) directing the light of said desired intensity level from each light source onto said light modulator.

22. A display system according to claim 18, wherein the spectral response of said photodetector may vary from photodetector to photodetector and wherein the value representative of the desired intensity level is pre-calibrated to vary proportionally with the photodetector spectral response variation.

23. A display system according to claim 9, wherein said sensing mechanism includes a plurality of photodetectors each configured to sense light of a specific range of wavelengths and wherein each range of wavelengths is different.

24. A display system, comprising:

a light modulator;

a separate illumination device including three light sources, each of the three light sources providing light that is substantially in a different color band than two others of the three light sources, each of the three light sources providing an output light intensity related to an input corresponding to that light source; and a calibrating arrangement that establishes the inputs to the three light sources, the arrangement including a light sensing arrangement that separately senses the output light intensity from each of the three differently-colored light sources and based thereon separately adjusts the input to each of the three differently-colored light sources to achieve a desired output light intensity from each differently-colored light source to achieve a desired color balance in the combination of the light from each of the three differently-colored light sources.

25. A display system, comprising:

a spatial light modulator divided into an array of individually controllable pixels;

a separate light source that provides light to the modulator, the intensity of the light provided being a function of an input signal provided to the light source, wherein said light source has been characterized prior to installation in the display system to determine the magnitude of the input signal that is required to provide a predetermined light intensity, the determined magnitude having been stored as calibration information specific to said particular light source in a memory device associated with the light source;

wherein the calibration information is utilized during operation of the display device to achieve a desired light intensity.

26. A display system as defined in claim 25, wherein there are three such separate light sources, each of the three light sources providing light of a different color.

27. A display system as defined in claim 26, wherein the three light sources are operated in a cyclical, sequential fashion to achieve a perception of white light in the case where the spatial light modulator provides the same degree of modulation for each element of the sequence.

28. A display system as defined in claim 25, wherein the light source is an LED and the light intensity therefrom is a function of the magnitude of the electrical current of the input signal.

* * * * *